US008970098B1

(12) United States Patent
Saji et al.

(10) Patent No.: US 8,970,098 B1
(45) Date of Patent: Mar. 3, 2015

(54) IGNITION PLUG

(71) Applicant: NGK Spark Plug, Co., Ltd., Nagoya (JP)

(72) Inventors: Toshimasa Saji, Kounan (JP); Hirokazu Kurono, Nagoya (JP); Toshitaka Honda, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/491,262

(22) Filed: Sep. 19, 2014

(51) Int. Cl.
*H01T 13/20* (2006.01)
*H01T 13/38* (2006.01)

(52) U.S. Cl.
CPC ..... *H01T 13/38* (2013.01)
USPC ..... 313/143; 313/145

(58) Field of Classification Search
CPC ..... H01T 13/20–13/39
USPC ..... 313/141–145
See application file for complete search history.

(56) References Cited

U.S. PATENT DOCUMENTS

| | | | | |
|---|---|---|---|---|
| 2006/0003091 | A1* | 1/2006 | Collardey et al. | 427/105 |
| 2007/0228915 | A1 | 10/2007 | Honda et al. | |
| 2008/0042539 | A1* | 2/2008 | Walker | 313/135 |
| 2009/0256461 | A1* | 10/2009 | Walker, Jr. | 313/137 |
| 2011/0005485 | A1* | 1/2011 | Kurono et al. | 123/169 R |
| 2012/0068390 | A1* | 3/2012 | Walker, Jr. | 264/632 |
| 2014/0243184 | A1* | 8/2014 | Fujimura et al. | 501/32 |

FOREIGN PATENT DOCUMENTS

| | | |
|---|---|---|
| JP | 11-43368 A | 2/1990 |
| JP | 4690230 B | 6/2011 |

* cited by examiner

*Primary Examiner* — Mariceli Santiago
(74) *Attorney, Agent, or Firm* — Leason Ellis LLP.

(57) ABSTRACT

An ignition plug includes an insulator having an axial hole extending therethrough in the direction of an axis, a center electrode inserted into a forward end portion of the axial hole, and a metallic shell disposed externally of the insulator. The insulator includes a step portion engaged with an inner circumferential portion of the metallic shell and a leg portion extending forward from the forward end of the step portion. The porosity of the leg portion is 3.0% or less. Among three regions of the leg portion that are radially trisected in a cross section perpendicular to the axis, the outermost region is defined as a first region and the innermost region is defined as a second region. The porosity of the first region is equal to or more than 1.20 times the porosity of the second region.

8 Claims, 5 Drawing Sheets

IGNITION PLUG

This application claims the benefit of Japanese Patent Applications No. 2013-202872 filed on Sep. 30, 2013, which is incorporated by reference in its entirety herein.

FIELD OF THE INVENTION

The present invention relates to an ignition plug for use in an internal combustion engine or the like.

BACKGROUND OF THE INVENTION

An ignition plug is attached to an internal combustion engine (engine) etc. and used to ignite, for example, an air-fuel mixture in a combustion chamber. Generally, an ignition plug includes an insulator having an axial hole extending in an axial direction, a center electrode inserted into a forward end portion of the axial hole, a metallic shell disposed externally of the insulator, and a ground electrode fixed to a forward end portion of the metallic shell. The insulator is fixed to the metallic shell in a state in which a step portion provided on the outer circumference of the insulator is engaged with an inner circumferential portion of the metallic shell directly or through a metal-made sheet packing. A spark discharge gap is formed between a distal end portion of the ground electrode and a forward end portion of the center electrode. A high voltage is applied across the spark discharge gap to generate spark discharge, whereby an air-fuel mixture, for example, is ignited.

In engines proposed in recent years, to improve fuel economy and to cope with environmental regulations, the degree of supercharging and the dree of compression, for example, are increased. In these engines, since the pressure inside each combustion chamber during operation is relatively high, the voltage necessary to generate spark discharge (discharge voltage) is also high. When the discharge voltage is high, spark discharge passing through the insulator (penetration discharge) may occur in a leg portion of the insulator which is located forward of the step portion and whose wall thickness is relatively small, and this may hinder normal spark discharge (may cause a misfire). Particularly, in recent years, to achieve a reduction in ignition plug size, the insulator is further reduced in wall thickness. The possibility of the occurrence of penetration discharge is particularly high in such a thin-walled insulator.

A possible measure for suppressing the occurrence of penetration discharge is increasing the denseness of the insulator, i.e., reducing the porosity of the insulator, to thereby increase the dielectric strength of the insulator. In one previously proposed technique (see, for example, Japanese Patent Application Laid-Open (kokai) No. H11-43368), the porosity of the insulator is reduced to 0.5% or less.

Problem to be Solved by the Invention

When the porosity of the insulator is significantly reduced in order to increase the dielectric strength, the hardness of the insulator increases, so that the Young's modulus of the insulator becomes relatively high. In the insulator with high Young's modulus, heating and cooling cause large thermal stress between outer and inner circumferential portions of the leg portion. Therefore, when a thermal cycle is repeated, breakage (cracking) easily occurs in the leg portion. When the porosity of the insulator is increased, the thermal shock resistance of the insulator can be enhanced, but its dielectric strength decreases. Specifically, the dielectric strength and the thermal shock resistance are in a trade-off relation, and therefore it is very difficult to obtain both high dielectric strength and high thermal shock resistance simultaneously.

The present invention has been made in view of the above circumstances, and an object of the invention is to provide an ignition plug whose insulator has sufficiently increased dielectric strength and thermal shock resistance.

SUMMARY OF THE INVENTION

Means for Solving the Problem

Configurations suitable for achieving the above object will next be described in itemized form. When needed, actions and effects peculiar to the configurations will be described additionally.

Configuration 1. An ignition plug of the present configuration comprises:

an insulator having an axial hole extending therethrough in the direction of an axial line (axis);

a center electrode inserted into a forward end portion of the axial hole; and a metallic shell disposed externally of the insulator, wherein the insulator includes a step portion engaged with an inner circumferential portion of the metallic shell and a leg portion extending forward from a forward end of the step portion, the porosity of the leg portion of the insulator is 3.0% or less, and the porosity of a first region is equal to or more than 1.20 times the porosity of a second region, where the first region is an outermost region of three regions of the leg portion that are radially trisected in a cross section perpendicular to the axial line, and the second region is an innermost region of the three regions.

In configuration 1 described above, the porosity of the leg portion is 3.0% or less, and the leg portion is sufficiently dense. Therefore, sufficient dielectric strength can be achieved.

In configuration 1 described above, the porosity of the first region located on the outer circumferential side is equal to or more than 1.20 times the porosity of the second region on the inner circumferential side, so the denseness of the first region located on the outer circumferential side is relatively low. Therefore, the Young's modulus in the first region can be reduced, and thermal stress generated between the outer and inner circumferential portions of the leg portion during heating and cooling can be reduced.

In configuration 1 described above, since the porosity of the second region is relatively small, inward compressive stress remains in the inner circumferential portion. When the outer circumferential portion shrinks rapidly during rapid cooling and tensile stress occurs on the surface, the remaining compressive stress can further reduce the thermal stress generated between the outer and inner circumferential portions. Therefore, sufficient thermal shock resistance can be obtained.

Configuration 2. An ignition plug of the present configuration is characterized in that, in the above-described configuration 1, the porosity of a third region is equal to or less than 1.05 times the porosity of the second region, where the third region is located between the first region and the second region in the cross section.

In configuration 2 described above, the porosity of the third region located in the radially central portion of the leg portion is equal to or less than 1.05 times the porosity of the second region formed so as to be relatively dense. Specifically, the third region is as dense as the second region. Therefore, the leg portion can be dense over a wide area in the radial direction, and the dielectric strength can be further increased.

Configuration 3. An ignition plug of the present configuration is characterized in that, in the above-described configuration 1 or 2, the maximum wall thickness of the leg portion in a direction perpendicular to the axial line is 0.50 mm or more and 2.00 mm or less.

In configuration 3 described above, since the maximum wall thickness of the leg portion is set to 2.00 mm or less, it is very difficult to ensure sufficient dielectric strength. However, when, for example, configuration 1 is employed, sufficient di strength can be obtained even when the leg portion is thin-walled. In other words, configuration 1 etc. are particularly effective for an ignition plug in which the maximum wall thickness of the leg portion is 2.00 mm or less and sufficient dielectric strength is difficult to ensure.

In configuration 3 described above, the maximum wall thickness of the leg portion is set to 0.50 mm or more. Therefore, a combination of configuration 3 and configuration 1 etc. allows sufficiently high dielectric strength to be obtained.

Configuration 4. An ignition plug of the present configuration is characterized in that, in any of the above-described configurations 1 to 3, at least one of a mullite crystal phase and an aluminate crystal phase is present on the outer surface of the leg portion.

In configuration 4 described above, the mullite crystal phase and the aluminate crystal phase can reduce the amount of thermal expansion of the leg portion. Therefore, the thermal stress generated between the outer and inner circumferential portions of the leg portion can be further reduced. As a result, the thermal shock resistance can be further enhanced.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying out the Invention

Figure 1:
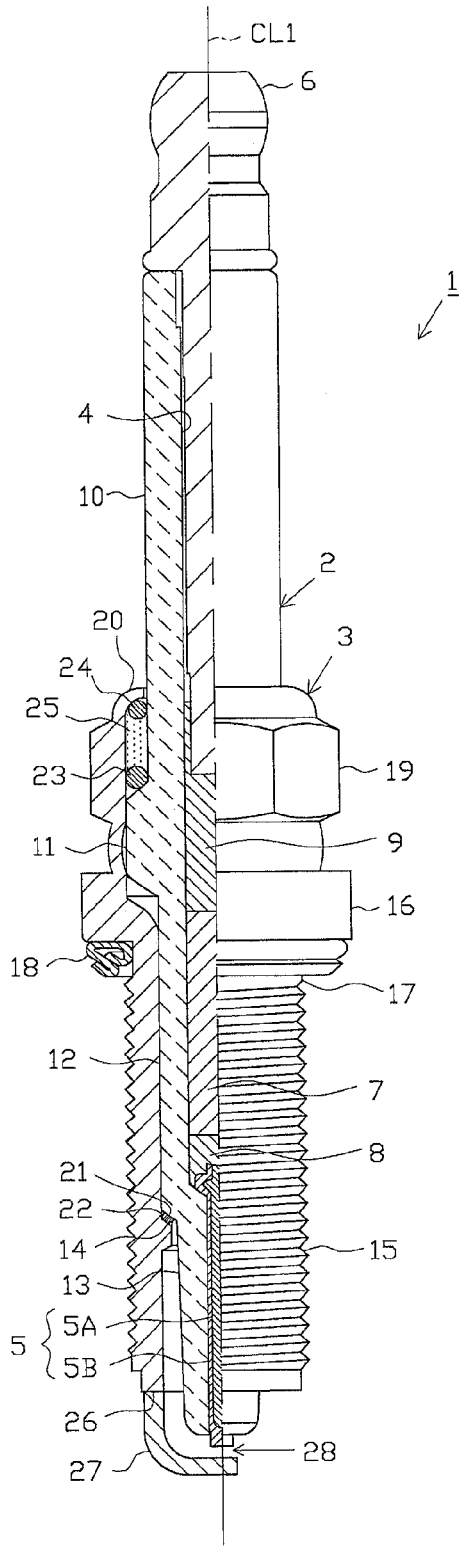
FIG. 1 is a partially cutaway front view showing the configuration of an ignition plug.

An embodiment of the present invention will next be described with reference to the drawings. FIG. 1 is a partially cutaway front view showing an ignition plug 1. In the following description with reference to FIG. 1, the direction of an axial line CL1 of the ignition plug 1 is referred to as the vertical direction; the lower side is referred to as the forward side of the ignition plug 1; and the upper side as the rear side.

The ignition plug 1 includes a tubular insulator 2, a tubular metallic shell 3 that holds the insulator 2, and other components.

The insulator 2 is formed from alumina or the like by firing, as well known in the art. The insulator 2, as viewed externally, includes a rear trunk portion 10 formed on the rear side; a large-diameter portion 11 that is located forward of the rear trunk portion 10 and protrudes radially outward; an intermediate trunk portion 12 that is located forward of the large-diameter portion 11 and is smaller in diameter than the large-diameter portion 11; and a leg portion 13 that is located forward of the intermediate trunk portion 12 and is smaller in diameter than the intermediate trunk portion 12. The large-diameter portion 11, the intermediate trunk portion 12, and most of the leg portion 13 of the insulator 2 are accommodated in the metallic shell 3. A tapered, stepped portion 14 is formed between the intermediate trunk portion 12 and the leg portion 13. The insulator 2 is engaged with the metallic shell 3 at the stepped portion 14.

The insulator 2 has an axial hole 4 extending therethrough along the axial line CL1, and a center electrode 5 is inserted into a forward end portion of the axial hole 4. The center electrode 5 includes an inner layer 5A formed of a metal having good thermal conductivity (e.g., copper, a copper alloy, or pure nickel (Ni)) and an outer layer 5B formed of an alloy containing nickel (Ni) as a main component. The center electrode 5 has a rod-like (circular columnar) shape as a whole and has a forward end portion protruding from the forward end of the insulator 2.

A terminal electrode 6 is fixedly inserted into a rear end portion of the axial hole 4 and protrudes from the rear end of the insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The metallic shell 3 is formed into a tubular shape from a metal such as low-carbon steel and has, on its outer circumferential surface, a threaded portion (externally threaded portion) 15 for mounting the ignition plug 1 on an internal combustion engine, a fuel cell reformer, etc. A seat portion 16 protruding outward is formed rearward of the threaded portion 15. A ring-like gasket 18 is fitted to a screw neck 17 located at the rear end of the threaded portion 15. The metallic shell 3 further has, at its rear end portion, a tool engagement portion 19 and a crimped portion 20 bent radially inward. The tool engagement portion 19 has a hexagonal cross section and allows a tool such as a wrench to be engaged therewith when the ignition plug 1 is attached to, for example, an internal combustion engine. In the present embodiment, to reduce the diameter of the ignition plug 1, the metallic shell 3 is reduced in diameter (e.g., the thread diameter of the threaded portion 15 is M12 or less).

A tapered portion 21 with which the insulator 2 is engaged is provided on the inner circumferential surface of the metallic shell 3. The insulator 2 is inserted into the metallic shell 3 from the rear end side thereof toward the forward end side, and the step portion 14 is engaged with the tapered portion 21 of the metallic shell 3. In this state, a rear opening portion of the metallic shell 3 is crimped radially inward, i.e., the crimp portion 20 is formed. As a result, the insulator 2 is fixed to the metallic shell 3. An annular sheet packing 22 is interposed between the step portion 14 and the tapered portion 21. This maintains airtightness inside a combustion chamber, so that fuel gas entering the gap between the inner circumferential surface of the metallic shell 3 and the leg portion 13 of the insulator 2, exposed to the combustion chamber, is prevented from leaking to the outside.

To make the seal achieved by crimping more complete, annular ring members 23 and 24 are interposed between the metallic shell 3 and the insulator 2 at the rear end of the metallic shell 3, and the gap between the ring members 23 and 24 is filled with powder of talc 25. More specifically, the metallic shell 3 holds the insulator 2 through the sheet packing 22, the ring members 23 and 24, and the talc 25.

A rod-shaped ground electrode 27 is joined to a forward end portion 26 of the metallic shell 3. The ground electrode 27 is bent at its intermediate portion, and a side surface of a distal end portion of the ground electrode 27 faces the forward end portion of the center electrode 5. A spark discharge gap 28 is formed between the forward end portion of the center electrode 5 and the distal end portion of the ground electrode 27, and spark discharge is generated in the spark discharge gap 28 in a direction substantially along the axial line CL1.

In the present embodiment, the porosity of the leg portion 13 is 3.0% or less. The porosity can be determined by the following method. The leg portion 13 is cut in a direction orthogonal to the axial line CL1, and the cut section is mirror-polished. Then the polished surface is observed under an SEM (e.g., acceleration voltage: 20 kV, spot size: 50, COMPO image (composition image)) to acquire one image or a plurality of split images so that pores over the entire polished surface can be identified. The area ratio of the pore portions is measured in the acquired image(s), and the porosity can thereby be determined. The area ratio of the pore portions can be measured using prescribed image analysis software (e.g., Analysis Five of Soft Imaging System GmbH). When the exemplified image analysis software is used, an appropriate threshold value is set such that the pore portions can be selected over the entire image of the polished surface.

Figure 2:
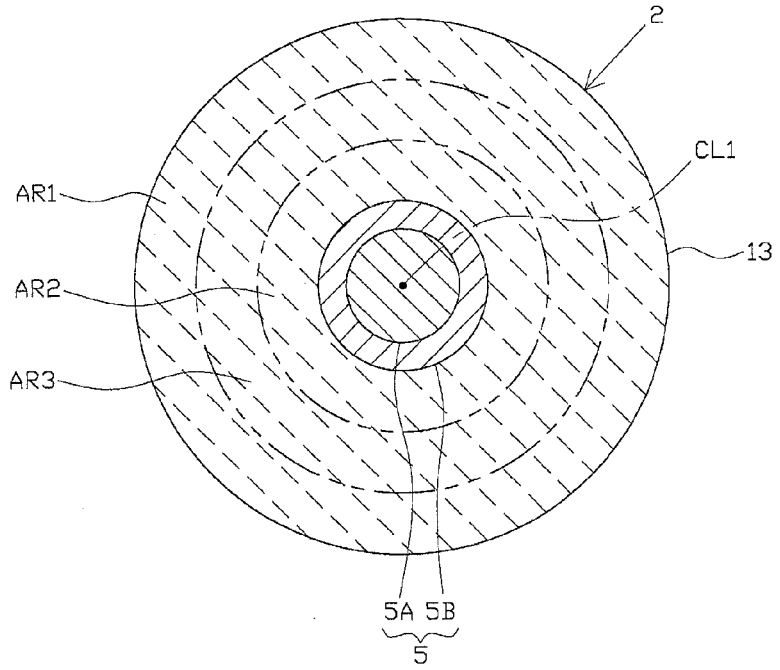
FIG. 2 is an enlarged sectional view of a leg portion etc. taken in a direction orthogonal to an axial line.

Next, as shown in FIG. 2, the leg portion 13 is trisected radially in a cross section perpendicular to the axial line CL1. An outermost region is referred to as a first region AR1, and an innermost region is referred to as a second region AR2. In this case, the porosity PO1 of the first region AR1 is equal to or more than 1.20 times the porosity PO2 of the second region AR2, and therefore the leg portion 13 is formed such that the first region AR1 is less dense than the second region AR2.

In addition, a region between the first region AR1 and the second region AR2 in the cross section is referred to as a third region AR3. In this case, the porosity PO3 of the third region AR3 is equal to or less than 1.05 times the porosity PO2 of the second region AR2. Specifically, the third region AR3 is formed so as to be as dense as the relatively dense second region AR2.

Figure 3:
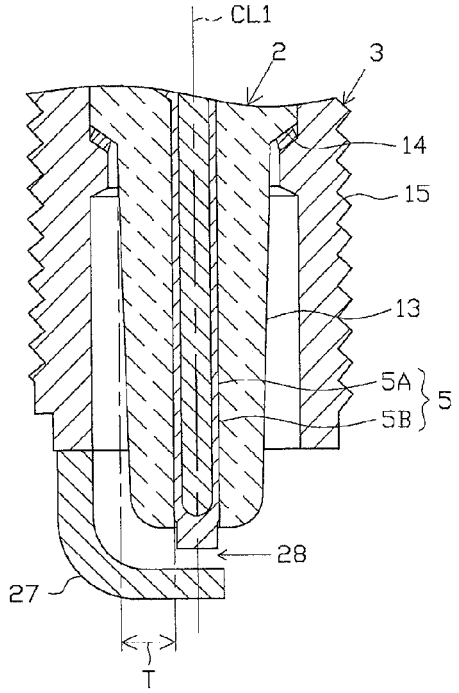
FIG. 3 is an enlarged sectional view showing the maximum wall thickness of the leg portion.

Since the metallic shell 3 is reduced in diameter, the insulator 2 is also reduced in wall thickness. Therefore, as shown in FIG. 3, the maximum wall thickness T of the leg portion 13 in a direction orthogonal to the axial line CL1 is set to 2.00 mm or less. In the present embodiment, to prevent an excessive reduction in the dielectric strength and mechanical strength of the leg portion 13, the maximum wall thickness T is set to 0.50 mm or more.

In the present embodiment, the leg portion 13 is configured such that at least one of a mullite crystal phase and an aluminate crystal phase is present on the outer surface of the leg portion 13. The mullite crystal phase may be produced from alumina ($Al_2O_3$) and silica ($SiO_2$) contained in a raw material powder in a later-described firing step of forming the insulator 2. Alternatively, the leg portion 13 may be formed such that the mullite crystal phase is present on the outer surface of the leg portion 13 by mixing mullite powder into a raw material powder in advance. The aluminate crystal phase may be produced in the firing step from alumina and a rare-earth element (such as Sc, Y, La, Pr, Nd, Pm, Sm, Eu, Gd, Tb, Dy, Ho, Er, Tm, Yb, or Lu) contained in a raw material powder or from alumina and a group 2 element (such as Mg, Ca, Sr, or Ba) contained in the raw material powder. Alternatively, the leg portion 13 may be formed such that the aluminate crystal phase is present on the outer surface of the leg portion 13 by mixing aluminate powder into a raw material powder in advance.

Next, a description will be given of a method of producing the ignition plug 1 configured as described above.

First, the metallic shell 3 is formed beforehand. Specifically, a circular columnar metal material (e.g., an iron-based or stainless steel material such as S17C or S25C) is subjected to cold forging to form a through hole, whereby a general shape is formed. Then cutting is performed to adjust the outer shape, and a metallic shell intermediate is thereby obtained.

Then the ground electrode 27 formed of a Ni alloy is resistance-welded to a forward end face of the metallic shell intermediate. Since so-called "sags" occur during the resistance welding, the "sags" are removed, and then the threaded portion 15 is formed at a prescribed portion of the metallic shell intermediate by rolling. A metallic shell 3 with the ground electrode 27 welded thereto is thereby obtained. The metallic shell 3 with the ground electrode 27 welded thereto is plated with zinc or nickel. In order to enhance corrosion resistance, the plated surface may be further subjected to chromate treatment.

Separately from the metallic shell 3, the insulator 2 is produced in advance. More specifically, first, a prescribed binder is added to a raw material powder including alumina ($Al_2O_3$) powder as a main component and a sintering agent containing at least one of silica ($SiO_2$), a rare-earth element, a group 2 element, etc., and these components are wet-mixed using water as a solvent to thereby prepare a slurry. The prepared slurry is sprayed and dried to obtain a particulate material.

Figure 4:
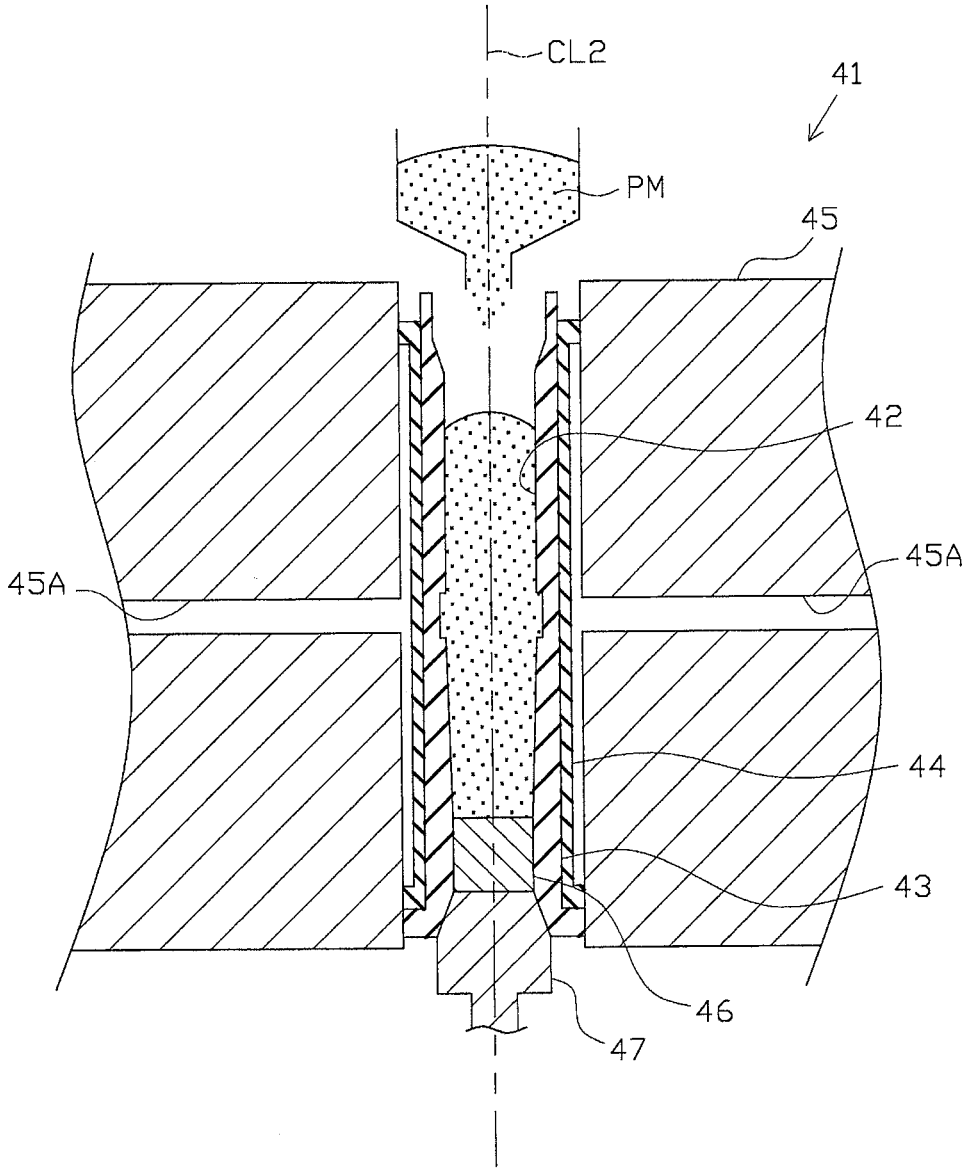
FIG. 4 is a schematic sectional view showing a step in a process of producing an insulator.

The obtained particulate material is subjected to rubber press forming using a rubber press machine 41 to produce a green compact. As shown in FIG. 4, the rubber press machine 41 includes a cylindrical inner rubber die 43 having a cavity 42 extending in the direction of a center axis CL2, a cylindrical outer rubber die 44 disposed externally of the inner rubber die 43, a rubber press machine main body 45 disposed externally of the outer rubber die 44, a bottom lid 46 for closing a lower opening of the cavity 42, and a lower holder 47. Liquid passages 45A are provided in the rubber press machine main body 45. By applying hydraulic pressure to the outer circumferential surface of the outer rubber die 44 in the radial direction through the liquid passages 45A, the cavity 42 can be shrunk radially.

Figure 5:
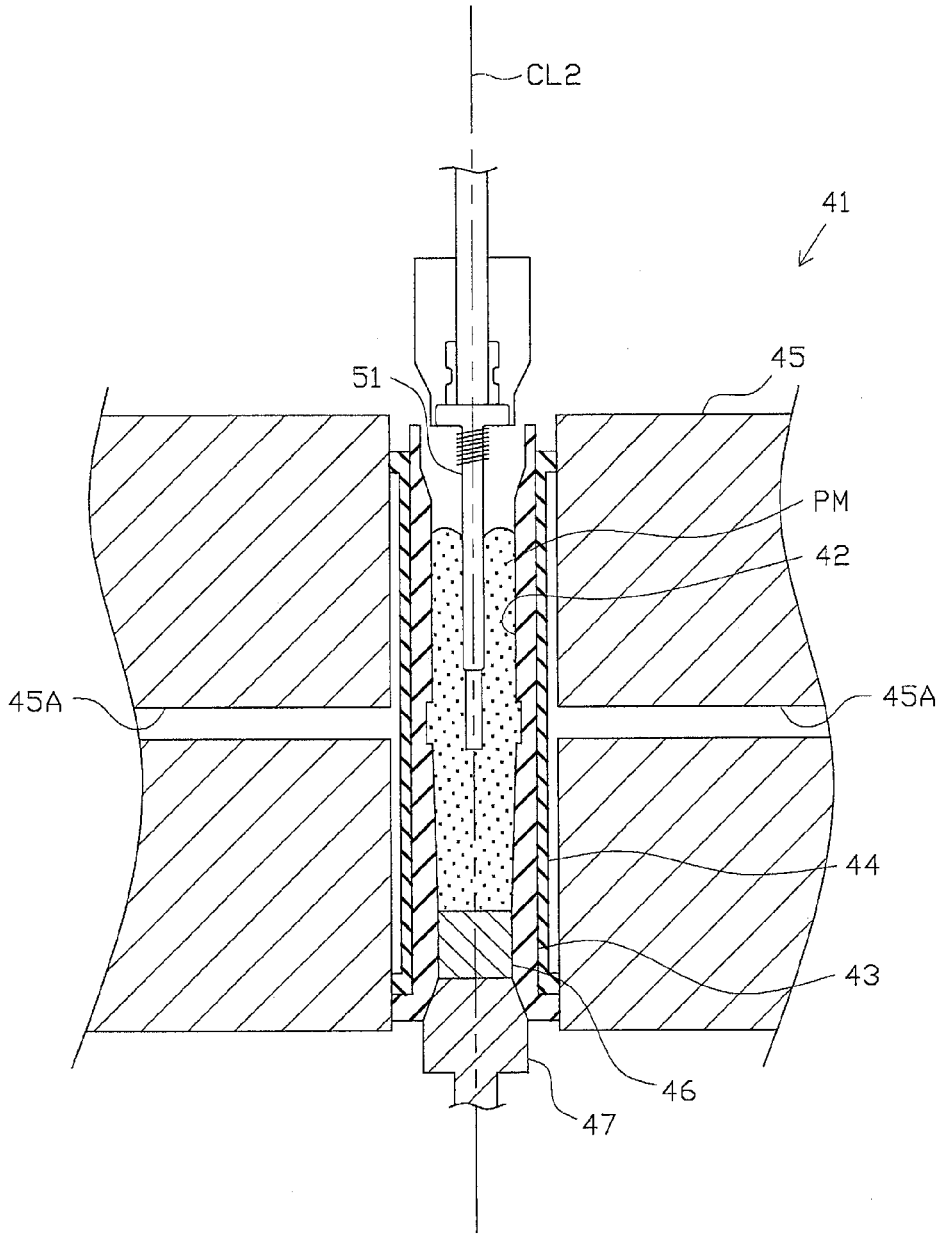
FIG. 5 is a schematic sectional view showing another step in the process of producing the insulator.

Returning to the description of the production method, first, the particulate material PM is charged into the cavity 42 of the inner rubber die 43. Next, as shown in FIG. 5, a pressing pin 51 made of a high-hardness material such as a metal or ceramic and used to form the axial hole 4 is disposed inside the cavity 42.

Figure 6:
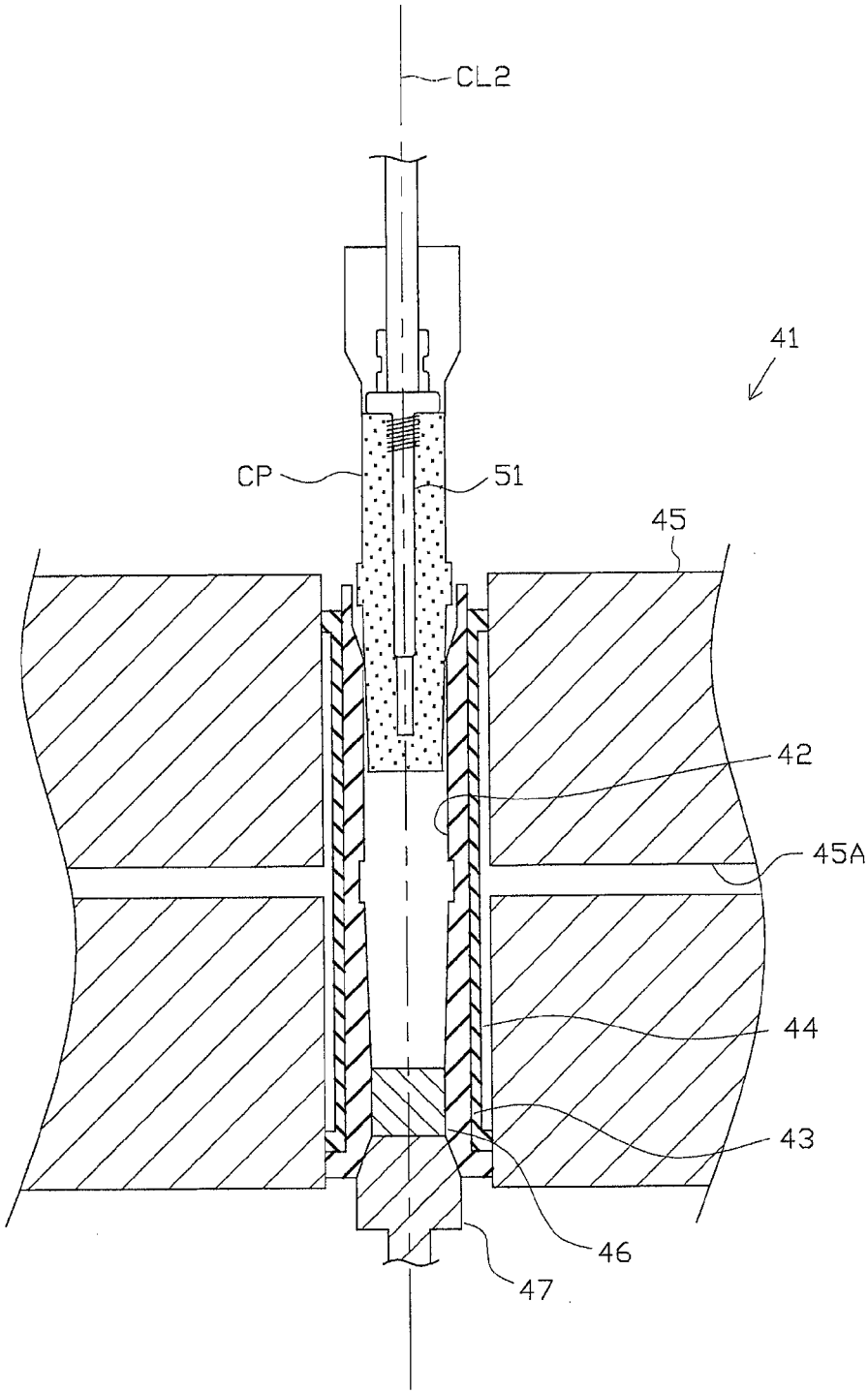
FIG. 6 is a schematic sectional view showing another step in the process of producing the insulator.

Next, hydraulic pressure is applied through the liquid passages 45A, and pressure is thereby applied externally to the inner rubber die 43 and the outer rubber die 44 to shrink the cavity 42. After a lapse of a prescribed time, the application of the hydraulic pressure is released. Then the pressing pin 51 is pulled up from the rubber press machine 41 in the direction of the center axis CL2 as shown in FIG. 6. As a result, the compact CP formed by compressing the particulate material PM is removed from the cavity 42 together with the pressing pin 51. Then the pressing pin 51 is rotated relative to the compact CP to pull the pressing pin 51 out from the compact CP, whereby the compact CP is obtained. In the present embodiment, a portion of the particulate material PM that is located in the vicinity of the pressing pin 51 is compressed to a higher degree. This is achieved by controlling the hydraulic pressure such that the pressure increasing speed of the inner rubber die 43 (the shrinking speed of the inner rubber die 43) is relatively fast or by using a relatively thin-walled inner rubber die 43 and/or a relatively thin-walled outer rubber die 44. In this manner, the compact CP is formed such that its denseness decreases radially from the inner side toward the outer side. In the present embodiment, by controlling the pressure increasing speed to a certain speed, the radially central portion of the compact CP becomes sufficiently dense. By controlling the pressure applied to the particulate material PM and the time of application of the pressure, the amount of pores in the compact CP is sufficiently reduced.

Next, the outer circumference of the obtained compact CP is subjected to grinding to obtain an insulator intermediate having an outer shape substantially the same as the outer shape of the insulator 2. The insulator intermediate is fired in a firing furnace in the firing step to obtain the insulator 2. As described above, the compact CP is formed such that its denseness decreases radially from the inner side toward the outer side. Therefore, in the obtained insulator 2, the porosity PO1 of the first region AR1 is equal to or more than 1.20 times the porosity PO2 of the second region AR2. Moreover, the radially central portion of the compact CP is sufficiently dense. Therefore, in the obtained insulator 2, the porosity PO3 of the third region AR3 is equal to or less than 1.05 times the porosity PO2 of the second region AR2. In addition, since the amount of pores in the compact CP is sufficiently small, the porosity of at least the leg portion 13 is 3.0% or less.

Separately from the metallic shell 3 and the insulator 2, the center electrode 5 is produced in advance. Specifically, a Ni alloy in which, for example, a copper alloy for improving heat dissipation is disposed at the center is subjected to forging to produce the center electrode 5.

The insulator 2 and the center electrode 5 that are obtained as described above, the resistor 7, and the terminal electrode 6 are fixed in a sealed condition via the glass seal layers 8 and 9. The glass seal layers 8 and 9 are generally formed as follows. A mixture of borosilicate glass and a metal powder is charged into the axial hole 4 of the insulator 2 so as to sandwich the resistor 7. Then, while the charged mixture is heated in a firing furnace, pressure is applied to the mixture from its rear side through the terminal electrode 6 to thereby fire the mixture. At the same time, a glaze layer may be formed on the surface of the rear trunk portion 10 of the insulator 2 through firing. Alternatively, the glaze layer may be formed in advance.

Next, the insulator 2 provided with the center electrode 5 and the terminal electrode 6 and produced as described above is fixed to the metallic shell 3 including the ground electrode 27 and produced as described above. More specifically, after the insulator 2 is inserted into the metallic shell 3, the relatively thin-walled rear opening portion of the metallic shell 3 is crimped radially inward, i.e., the crimp portion 20 is formed, whereby the insulator 2 and the metallic shell 3 are fixed to each other.

Finally, the intermediate portion of the ground electrode 27 is bent toward the center electrode 5, and the size of the spark discharge gap 28 formed between the center electrode 5 and the ground electrode 27 is adjusted, whereby the above-described ignition plug 1 is obtained.

As described above in detail, in the present embodiment, the porosity of the leg portion 13 is 3.0% or less, and the leg portion 13 is sufficiently dense. Therefore, sufficient dielectric strength can be achieved. Particularly, in the present embodiment, the maximum wall thickness T of the leg portion 13 is set to be 2.00 mm or less. In such a case, it is generally difficult to ensure sufficient dielectric strength. However, according to the present embodiment, sufficient dielectric strength can be obtained.

In the present embodiment, the porosity PO1 of the first region AR1 is equal to or more than 1.20 times the porosity PO2 of the second region AR2, and the denseness of the first region AR1 is relatively low. Therefore, the Young's modulus of the first region AR1 can be reduced, and thermal stress generated between the outer and inner circumferential portions of the leg portion 13 during heating and cooling can be reduced.

In the present embodiment, since the porosity PO2 of the second region AR2 is relatively small, inward compressive stress remains in the inner circumferential portion. When the outer circumferential portion shrinks rapidly during rapid cooling and tensile stress occurs on the surface, the remaining compressive stress can further reduce the thermal stress generated between the outer and inner circumferential portions. Therefore, sufficient thermal shock resistance can be obtained.

In addition, the porosity PO3 of the third region AR3 is equal to or less than 1.05 times the porosity PO2 of the second region AR2 formed so as to be relatively dense, and the third region AR3 is as dense as the second region AR2. Therefore, the leg portion 13 can be dense over a wide area in the radial direction, and the dielectric strength can be further increased.

The present embodiment is configured such that at least one of the mullite crystal phase and the aluminate crystal phase is present on the outer surface of the leg portion 13. Therefore, the amount of thermal expansion of the leg portion 13 can be reduced, and the thermal stress generated between the outer and inner circumferential portions of the leg portion 13 can be further reduced. As a result, the thermal shock resistance can be enhanced.

To examine the actions and effects obtained by the above embodiment, a plurality of ignition plug samples were produced. These ignition plug samples were different in the porosity PO1(%) of the first region, the porosity PO2(%) of the second region, the porosity PO3(%) of the third region, the overall porosity PO0(%) of the leg portion, and the presence and absence of the mullite crystal phase and the aluminate crystal phase on the outer surface of the leg portion. A dielectric strength evaluation test and a thermal shock resistance evaluation test were performed on each of the samples.

The outline of the dielectric strength evaluation test is as follows. Specifically, 30 samples with the same porosity of the first region, etc. were prepared. The forward end portion of each sample was immersed in a prescribed insulating oil so that no spark discharge occurred between the center electrode and the ground electrode. Then voltage was applied to the center electrode, and the applied voltage was gradually increased. The applied voltage (penetration voltage) when discharge passing through the insulator (leg portion) occurred between the center electrode and the metallic shell was measured. Then the average of the penetration voltages of the 30 samples (the average penetration voltage) was computed. Samples with an average penetration voltage of 40 kV or more and 41 kV or less were considered to have sufficient dielectric strength and evaluated as "good." Samples with an average penetration voltage of 41 kV or more were considered to have very high dielectric strength and evaluated as "excellent." Samples with an average penetration voltage of less than 40 kV were considered to have poor dielectric strength and evaluated as "poor."

The outline of the thermal shock resistance evaluation test is as follows. Specifically, samples were heated at different heating temperatures for 30 minutes. Then each sample was dropped into water at 20° C. to quench that sample. Then a prescribed test solution was applied to the surface of the leg portion to make clear whether or not cracking was present in the leg portion, and whether or not cracking occurred in the leg portion was checked visually. Samples in which cracking occurred in the leg portion when the heating temperature was 180° C. or higher and lower than 200° C. were considered to have sufficient thermal shock resistance and evaluated as "good." Sample in which cracking occurred in the leg portion when the heating temperature was 200° C. or higher were considered to have very high thermal shock resistance and evaluated as "excellent." Samples in which cracking occurred in the leg portion when the heating temperature was lower than 180° C. were considered to have poor thermal shock resistance and evaluated as "poor."

Table 1 shows the results of these two tests. The porosity PO1 of the first region etc. were changed by controlling the pressure increasing speed when the compact was formed. Separately from the samples for the above tests, samples for porosity measurement were separately produced under the same conditions as those for the samples for the above tests. The porosity PO1 of the first region etc. were measured using each of the samples for porosity measurement. Specifically, the leg portion was cut in a direction orthogonal to the axial line, and the cut section was mirror-polished. Then the porosity was measured at ten points for each of the first to third regions under a prescribed electron microscope, and the averages of the measured porosity values were used as the porosities PO1 to PO3 of the first to third regions. The average of the porosities at the 30 points in the first to third regions was used as the overall porosity PO0 of the leg portion. In addition, whether or not the mullite crystal phase or the aluminate crystal phase was present on the outer surface of the leg portion was determined by examining whether or not peaks intrinsic to the mullite crystal phase or the aluminate crystal phase were detected when the outer surface of the leg portion was subjected to X-ray diffraction analysis using a prescribed X-ray diffraction apparatus.

In samples 6, the wall thickness of the insulator was significantly smaller than (specifically, about ⅔) the wall thickness of the insulator in any of the other samples. In this case, it is generally very difficult to ensure sufficient dielectric strength.

As can be seen from Table 1, in samples in which the overall porosity PO0 of the leg portion was more than 3.0% (samples 1), dielectric strength was insufficient.

As is clear from Table 1, in samples in which although the overall porosity PO0 of the leg portion was 3.0% or less, PO1/PO2 was less than 1.20 (i.e., the porosity PO1 of the first region was less than 1.20 times the porosity PO2 of the second region) (samples 2), dielectric strength was sufficient, but thermal shock resistance was poor. This may be because since the first region was very dense and the Young's modulus of the first region was relatively high, thermal stress generated in the leg portion during rapid cooling was large.

However, in samples in which the overall porosity PO0 of the leg portion was 3.0% or less and PO1/PO2 was 1.20 or more (i.e., the porosity PO1 of the first region was equal to or more than 1.2 times the porosity PO2 of the second region) (samples 3 to 8), both the dielectric strength and the thermal shock resistance were found to be sufficient. This may be because of the following (1) to (3).

(1) Since the porosity PO0 was 3.0% or less, the denseness of the leg portion was sufficiently increased.

(2) Since the porosity PO1 was equal to or more than 1.20 times the porosity PO2, the Young's modulus of the first region was sufficiently small, and the thermal stress generated in the leg portion during rapid cooling was small.

(3) Since the porosity PO2 was relatively small, inward compression stress remained in the inner circumferential portion of the insulator. Therefore, when the outer circumferential portion of the insulator shrank rapidly during rapid cooling and tensile stress occurred in the surface, the thermal stress generated between the inner circumferential portion and the outer circumferential portion was further reduced.

It was found that samples in which PO3/PO2 was 1.05 or less (i.e., the porosity PO3 of the third region was equal to or less than 1.05 times the porosity PO2 of the second region) (samples 4 to 8) had higher dielectric strength. It was also found that, even in samples 6 in which the wall thickness of the insulator was significantly reduced, sufficient dielectric strength could be ensured. This may be because the leg portion was dense over a wide area in the radial direction.

It was found that samples in which the mullite crystal phase was present on the outer surface of the leg portion (samples 7) and samples in which the aluminate crystal phase was present on the surface of the leg portion (samples 8) had very high thermal shock resistance. This may be because the mullite crystal phase and the aluminate crystal phase reduced the amount of thermal expansion of the leg portion and therefore the thermal stress generated in the leg portion during rapid cooling was further reduced.

TABLE 1

| No. | First region porosity PO1 (%) | Second region porosity PO2 (%) | Third region porosity PO3 (%) | Leg portion porosity PO0 (%) | PO1/PO2 | PO3/P02 | Crystal phase | Dielectric strength | Thermal shock resistance |
|---|---|---|---|---|---|---|---|---|---|
| 1 | 3.87 | 3.85 | 3.85 | 3.9 | 1.01 | 1.00 | None | Poor | Excellent |
| 2 | 3.03 | 2.96 | 2.98 | 3.0 | 1.02 | 1.01 | None | Good | Poor |
| 3 | 3.26 | 2.72 | 2.97 | 3.0 | 1.20 | 1.09 | None | Good | Good |
| 4 | 3.24 | 2.64 | 2.77 | 2.9 | 1.23 | 1.05 | None | Excellent | Good |
| 5 | 2.14 | 1.73 | 1.81 | 1.9 | 1.24 | 1.05 | None | Excellent | Good |
| 6 | 3.22 | 2.68 | 2.78 | 2.9 | 1.20 | 1.04 | None | Good | Good |
| 7 | 3.24 | 2.64 | 2.77 | 2.9 | 1.23 | 1.05 | Mullite | Excellent | Excellent |
| 8 | 3.16 | 2.57 | 2.68 | 2.8 | 1.23 | 1.04 | Aluminate | Excellent | Excellent |

As can be seen from the results of the above tests, to obtain sufficient dielectric strength and sufficient thermal shock resistance simultaneously, it is preferable that the porosity of the leg portion is set to 3.0% or less and the porosity PO1 of the first region is set to be equal to or more than 1.20 times the porosity PO2 of the second region.

From the viewpoint of further increasing the dielectric strength, it is more preferable that the porosity PO3 of the third region is set to be equal to or less than 1.05 times the porosity PO2 of the second region.

In addition, from the viewpoint of further enhancing the thermal shock resistance, it is preferable to configure the leg portion such that at least one of the mullite crystal phase and the aluminate crystal phase is present on the outer surface of the leg portion.

The present invention is not limited to the contents of the description of the above embodiment and may be embodied, for example, as follows. It will be appreciated that application examples and modifications other than those exemplified below are also possible.

(a) In the above embodiment, the maximum wall thickness T of the leg portion 13 is set to 2.00 mm or less. However, the technological ideal of the present invention may be applied to an ignition plug in which the maximum wall thickness T is more than 2.00 mm.

(b) In the above embodiment, the ignition plug 1 is used to ignite, for example, an air-fuel mixture by generating spark discharge in the spark discharge gap 28. However, the configuration of the ignition plug to which the technological ideal of the present invention is applicable is not limited thereto. Therefore, the technological ideal of the present invention may be applied to, for example, an ignition plug that has a cavity (space) at the forward end portion of an insulator and jets plasma generated in the cavity to ignite, for example, an air-fuel mixture (a plasma jet ignition plug). The technological ideal of the present invention may be applied to an ignition plug that generates plasma between a center electrode and a ground electrode by applying high-frequency power between these electrodes (a high-frequency plasma ignition plug).

(c) In the above embodiment, the ground electrode 27 is joined to the forward end portion 26 of the metallic shell 3. However, the present invention is applicable to the case where a portion of a metallic shell (or a portion of an end metal piece welded beforehand to the metallic shell) is machined to form a ground electrode (see, for example, Japanese Patent Application Laid-Open (kokai) No. 2006-236906).

(d) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)].

DESCRIPTION OF REFERENCE NUMERALS

1: ignition plug
2: insulator
3: metallic shell
4: axial hole
5: center electrode
13: leg portion
14: step portion
AR1: first region
AR2: second region
AR3: third region
CL1: axial line

The invention claimed is:

1. An ignition plug comprising:

an insulator having an axial hole extending in the direction of an axis;

a center electrode inserted into a forward end portion of the axial hole; and a metallic shell disposed externally of the insulator, wherein the insulator includes a step portion engaged with an inner circumferential portion of the metallic shell and a leg portion extending forward from a forward end of the step portion, the porosity of the leg portion of the insulator is 3.0% or less, and the porosity of a first region is equal to or more than 1.20 times the porosity of a second region, where the first region is an outermost region of three regions of the leg portion that are radially trisected in a cross section perpendicular to the axis, and the second region is an innermost region of the three regions.

2. The ignition plug according to claim 1, wherein the porosity of a third region of the leg portion is equal to or less than 1.05 times the porosity of the second region, where the third region is located between the first region and the second region in the cross section.

3. The ignition plug according to claim 1, wherein the maximum wall thickness of the leg portion in a direction perpendicular to the axis is 0.50 mm or more and 2.00 mm or less.

4. The ignition plug according to claim 1, wherein at least one of a mullite crystal phase and an aluminate crystal phase is present on an outer surface of the leg portion.

5. The ignition plug according to claim 2, wherein the maximum wall thickness of the leg portion in a direction perpendicular to the axis is 0.50 mm or more and 2.00 mm or less.

6. The ignition plug according to claim 2, wherein at least one of a mullite crystal phase and an aluminate crystal phase is present on an outer surface of the leg portion.

7. The ignition plug according to claim 3, wherein at least one of a mullite crystal phase and an aluminate crystal phase is present on an outer surface of the leg portion.

8. The ignition plug according to claim 5, wherein at least one of a mullite crystal phase and an aluminate crystal phase is present on an outer surface of the leg portion.

* * * * *